United States Patent [19]

Todack

[11] Patent Number: 5,022,230

[45] Date of Patent: Jun. 11, 1991

[54] METHOD AND APPARATUS FOR RECLAIMING A REFRIGERANT

[76] Inventor: James J. Todack, 14407 Sycamore Lake Rd., Houston, Tex. 77062

[21] Appl. No.: 531,211

[22] Filed: May 31, 1990

[51] Int. Cl.[5] ..... F25B 45/00

[52] U.S. Cl. ..... 62/77; 62/85; 62/149; 62/292; 62/475

[58] Field of Search ..... 62/77, 292, 149, 85, 62/475

[56] References Cited

U.S. PATENT DOCUMENTS 3,232,070 2/1966 Sparano ..... 62/77 X 4,766,733 8/1988 Scuderi ..... 62/77

4,903,499 2/1990 Merritt ..... 62/149

4,939,903 7/1990 Goddard ..... 62/77

*Primary Examiner*—Lloyd L. King

*Attorney, Agent, or Firm*—Fulbright & Jaworski

[57] ABSTRACT

A portable refrigerant recovery and reclamation apparatus and method for removing and reclaiming fluorocarbon refrigerants from refrigeration systems through a closed loop preventing exposure of the refrigerant to the atmosphere. A refrigerant is drawn by suction to a boiler chamber, vaporized, condensed, filtered and recycled.

16 Claims, 5 Drawing Sheets

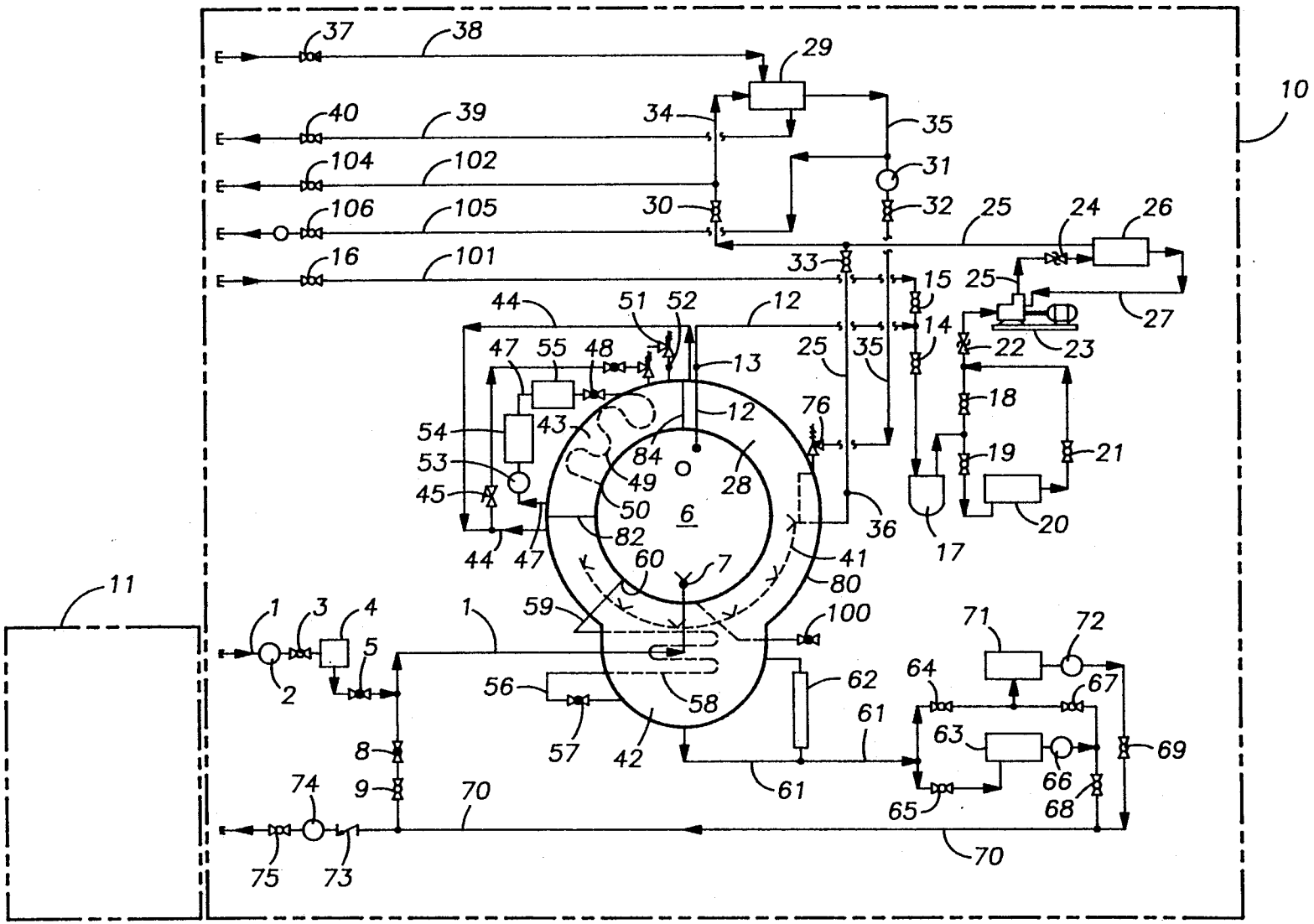

METHOD AND APPARATUS FOR RECLAIMING A REFRIGERANT

BACKGROUND OF THE INVENTION

In the past venting of refrigerants to the atmosphere, from refrigeration systems, was an expedient and economical method of removing contaminated refrigerants to permit repairs and allow the equipment to return to full production as quickly as possible. Scientific research has concluded that in the case of chloroflourocarbon (CFC) refrigerants, such venting to the atmosphere has lead to the depletion of the stratospheric ozone layer. In view of this, various taxes and legislative restrictions have been imposed to limit the production, use, and restrict and discourage discharging of such refrigerants. Alternative refrigerants are more costly and their use in present equipment is not compatible in all cases.

The above noted problems have necessitated the recovery and reclamation and reuse of present and future supplies of CFC refrigerants. The present invention relates to the field of recovery, reclamation, transfer and recharging of refrigerants for servicing of refrigeration and air conditioning systems. One feature of the present invention is the provision of a portable apparatus to permit the recycling and reclamation process to be performed while the refrigeration apparatus continues operating thereby preventing loss of production by the refrigeration system. A further advantage of the present invention is the removal of most of the contaminants such as acid, moisture, oil, solid particles and non-condensable gases by controlling temperatures.

The present invention also provides the capability to transfer refrigerants from a refrigeration apparatus requiring repairs, to a separate holding vessel whereby the present invention performs recycling and reclaiming of the refrigerant. Once repairs are completed on the refrigeration apparatus, the reclaimed refrigeration is reintroduced to the refrigeration apparatus by the transferring capability of the invention.

SUMMARY

The present invention is directed to an environmentally protective method and apparatus for withdrawing refrigerants from refrigerant systems with the ability to transfer, reclaim, recycle and recharge the refrigerants for continued use without allowing the escape of refrigerant to the atmosphere.

The present invention is directed to the provision of a refrigerant reclamation apparatus which includes a refrigerant boiler having a refrigerant inlet for admitting contaminated refrigerant into the boiler and having a vapor outlet. A compressor having a suction inlet is connected to the vapor outlet of the boiler for lowering the pressure and temperature in the boiler for drawing refrigerant into the boiler from the refrigerant inlet and for vaporizing the refrigerant in the boiler and separating most of the contaminates. A condenser is connected to the pressure outlet of the compressor for receiving a heated compressed refrigerant vapor and the condenser is positioned in a heat exchange relationship with the boiler for heating the boiler and also cooling the heated compressed vapor from the compressor to a condensed liquid. A sump is connected to the condenser for receiving the condensed liquids for reuse.

A further object of the present invention is the provision of a non-condensable gas purge chamber connected to the top of the condenser for receiving non-condensable gases. The purge chamber is positioned in a heat exchange relationship with the boiler for condensing any refrigerant in the chamber. Preferably, a cooling coil is positioned in the purge chamber for receiving and vaporizing part of the condensed refrigerant and the cooling coil is connected to the boiler for transmitting the vaporized refrigerant to the boiler. A float switch insures that only liquids are transmitted to the cooling coil. A gas outlet is provided in the top of the purge chamber for release of the non-condensable gases.

Another further object of the present invention is the provision of a recycling circuit connected between the sump and the boiler for recycling and further purifying the refrigerant.

Yet another further object is wherein a housing positioned about the boiler and the housing forms the condenser, purge chamber and sump.

A further object of the present invention is a provision of a sump sub-cooler coil including a cooling coil in the sump. The cooling coil is connected between the sump and the boiler whereby the liquid refrigerant in the sump vaporizes and cools the sump. The cooling coil sub-cooler located in the refrigerant sump was designed to lower the condensed refrigerant an additional amount thus causing the liquid line filters to absorb additional ppm's of moisture it would not be capable of absorbing if sub-cooling were not used.

A further object of the present invention is the provision of a second condenser connecting to the pressure outlet of the compressor upstream of the first condenser for controlling the temperature of the compressed vapor.

A further object of the present invention is the provision of an apparatus for connection to a refrigeration system including an inlet line having a sight glass connected to the refrigerant inlet, and outlet line connected to the sump for receiving reclaimed condensed liquids, and the inlet line and the outlet line are adapted to be connected to a refrigerant source for continuously reclaiming refrigerant.

A further object of the present invention is directed to the method of reclaiming a refrigerant through a closed process while preventing release of the refrigerant to the environment. The method includes withdrawing the refrigerant from a refrigeration system and into a closed boiler, lowering the pressure in the boiler by suction sufficiently to vaporize the refrigerant at a temperature in the range of approximately 10° F. to −15° F. for removing most of the liquid contaminates. The method includes removing the vaporized refrigerant from the boiler and compressing the vaporized refrigerant increasing its temperature. Thereafter, the heated vaporized refrigerant is placed in a heat exchange relationship with the boiler thereby heating the boiler and condensing the vaporized refrigerant. The method includes collecting and removing any non-condensable gases from the condensed refrigerant, and recharging the refrigeration system with the condensed refrigerant. The method may include passing the non-condensable gases in a heat exchange relationship with the boiler for condensing and extracting any refrigerant from and vaporizing any extracted refrigerant and returning it to the boiler. The method may also include cooling the condensed refrigerant by vaporizing part of the refrigerant and inserting the vaporized part into the boiler. The method also may include recycling part of the refrigerant for further purifying the refrigerant.

Another and further objects, features and advantages will be apparent from the following description of a presently preferred embodiment of the invention, given for the purpose of disclosure, and taken in conjunction with the accompanying drawing.

BRIEF DESCRIPTION OF THE DRAWINGS

FIG. 1 is a process flow diagram of the present invention.

Description of the Preferred Embodiment

For purposes of illustration only, the present apparatus and process will be described in connection with reclaiming the refrigerant R-12 along with typical operating parameters, for purposes of illustration only. However, the present method and apparatus can retrieve, clean, filter, transfer and reclaim other refrigerants such as R-11, R-22, R-500, R-502, R-114.

Figure 1A:
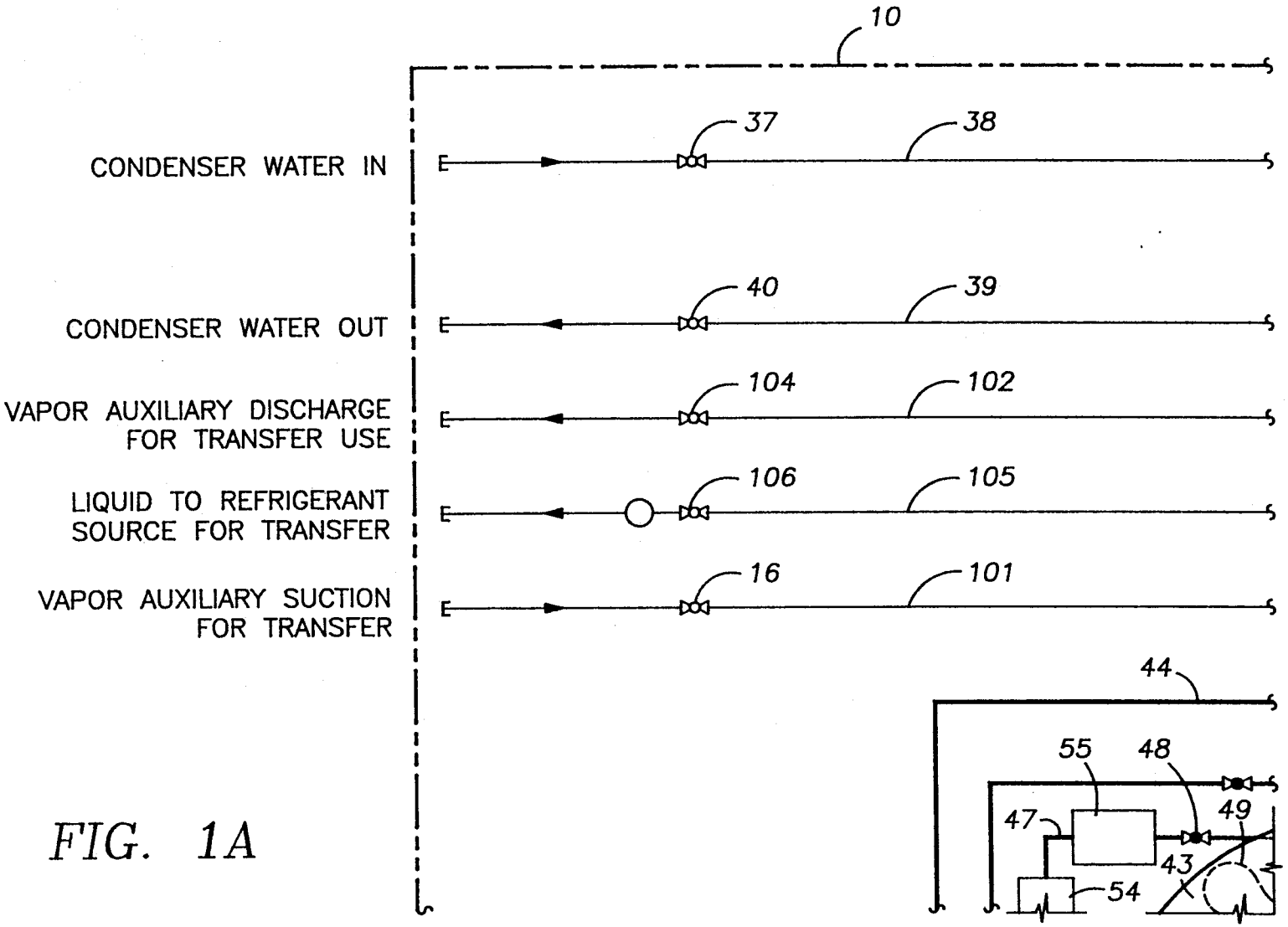
FIGS. 1A, 1B, 1C, 1D, are enlarged portions of FIG. 1.
Figure 1B:
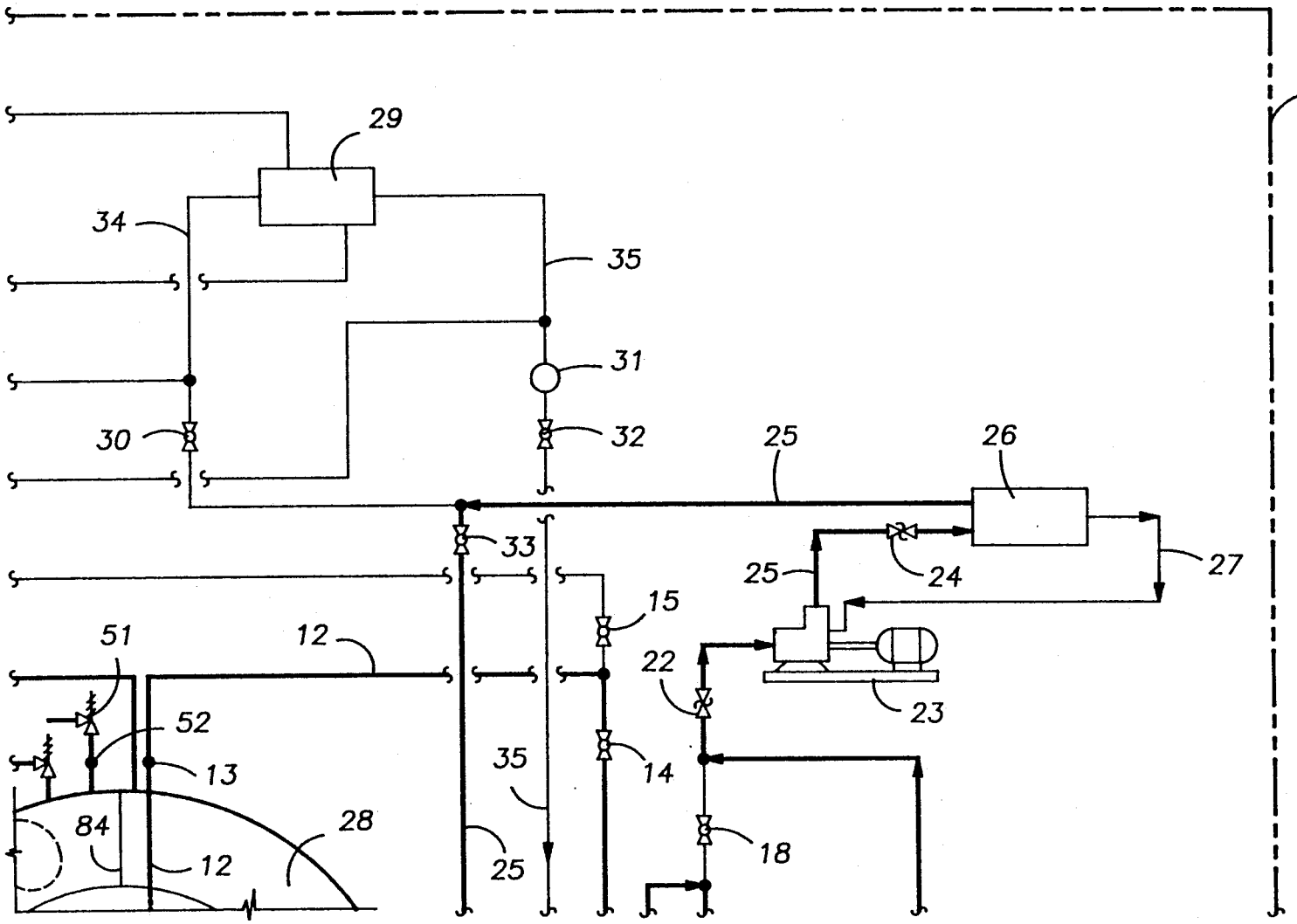
Figure 1C:
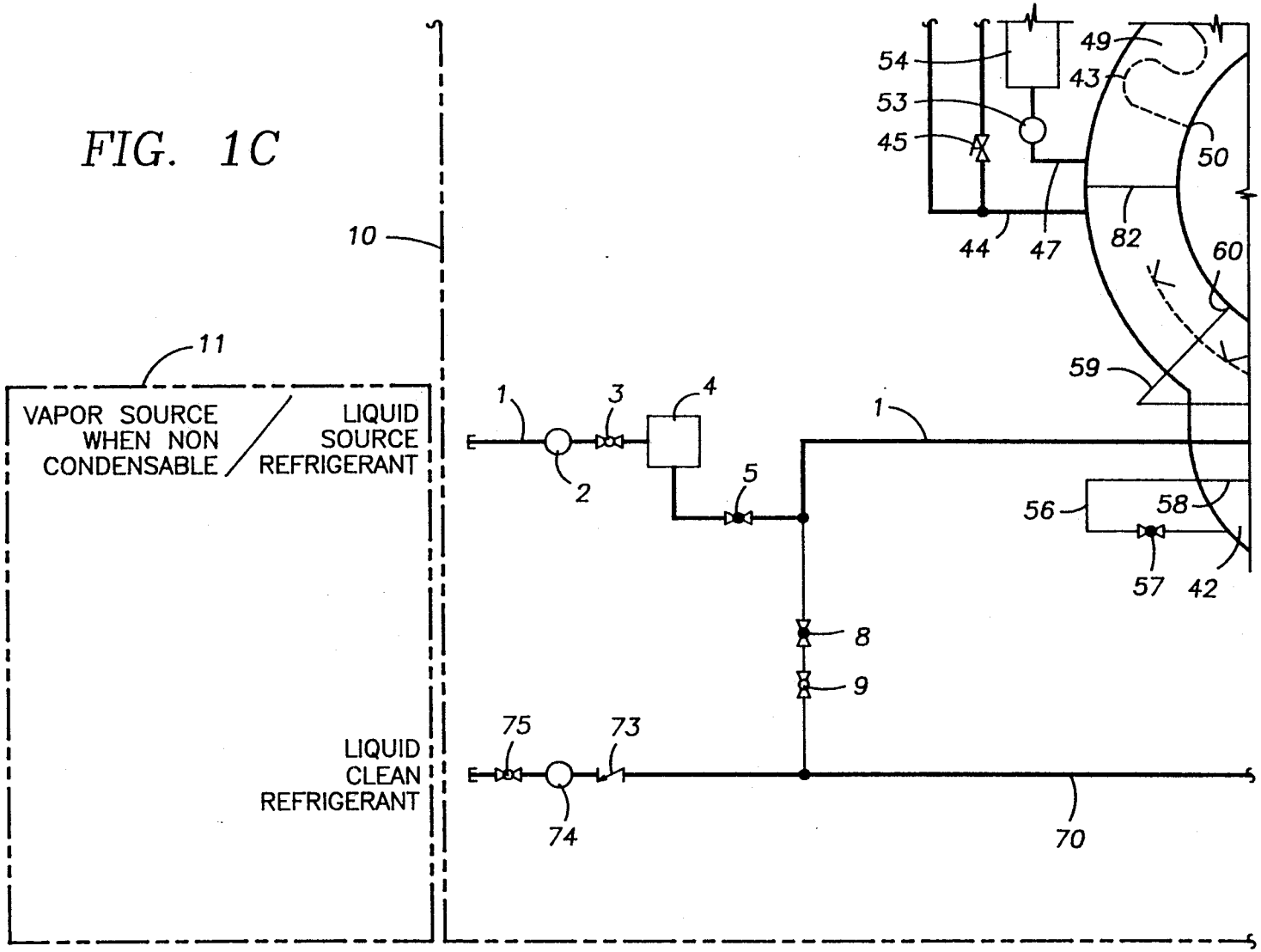
Figure 1D:
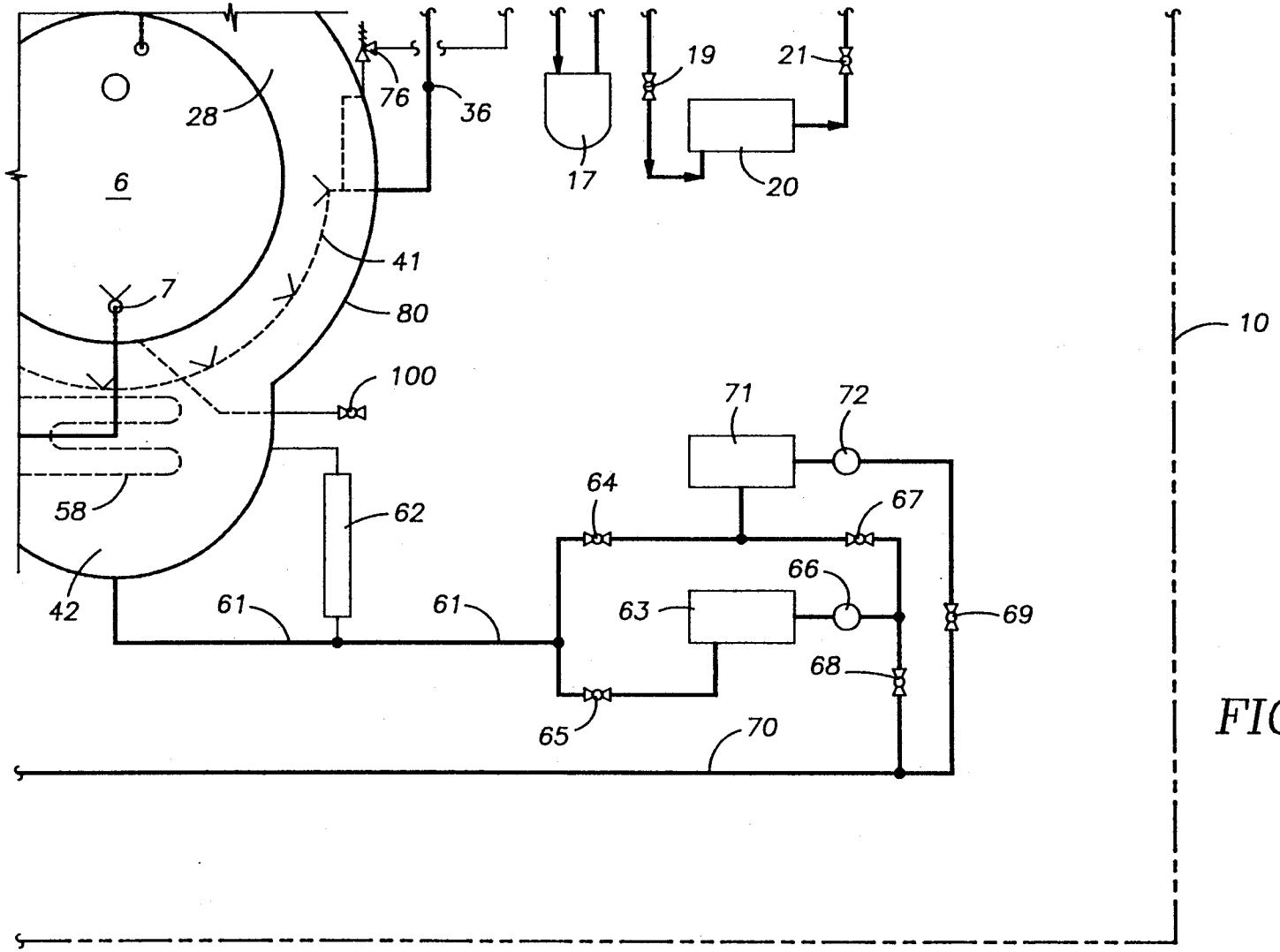

Referring now to the drawings, particularly to FIG. 1, the refrigerant reclamation and transfer apparatus of the present invention is generally indicated by the reference numeral 10. During operation, the apparatus 10 is in fluid communication with a refrigerant source such as either an operating refrigeration system or storage vessel 11. The system 11, for example only, may contain the refrigerant R-12, at a temperature of 60° F. and pressure of 57.7 psi and which is contaminated. The contaminated refrigerant may have contaminants such as acid, moisture, oil, solid particles and non-condensable gases.

The contaminated refrigerant is connected to the apparatus 10 through the input line 1. The visual condition of the entering refrigerant can be observed through sight glass 2 and the flow can be initially controlled by a flow/no flow hand operated input valve 3. The contaminated refrigerant then passes through a conventional solid particle filter 4 where most of the solid contaminants are removed. The filtered refrigerant then is metered into the refrigerant inlet 7 of a refrigerant boiler 6 by means of a needle valve 5. The inlet 7 may be a conventional spray tree where the liquid refrigerant is distributed in the bottom of the boiler 6.

The refrigerant is constantly being drawn through the input line 1 from the refrigeration system or storage 11 by means of a pressure differential between the refrigerant in the system 11 and the boiler 6. That is, the pressure is lower in the boiler 6. The lower pressure in the boiler 6 is produced by being connected to the suction inlet 12 of the compressor 23.

Preferably, the suction in the line 12 stays relatively constant. Therefore, pressure gauge 13 allows the operator to adjust the volume of the input through the needle valve 5 to maintain pressure/inches of vacuum in the refrigerant boiler 6 by varying the volume of the entering contaminated refrigerant. This allows the pressure in the refrigerant boiler 6 to be adjusted to control the boiling temperature of the liquid refrigerant in the boiler 12 for converting the liquid refrigerant to vapor and withdrawing the vaporized refrigerant through the suction inlet 12 to the compressor 23. The temperature is reduced for controlling the amount of moisture that the refrigerant is capable of retaining and separating any oil and most of any acids in the refrigerant. For example, using R-12, at 20° F. in the boiler 6, the refrigerant vapors will contain 16.6 ppm by weight of moisture. By reducing the temperature to 0° F. the same refrigerant can only hold 8.3 ppm by weight of moisture. The remaining moisture has become free water and freezes. The ice, acid, and oil can then be removed from the boiler 6 through valve 100. This separates the bulk of the contaminates from the refrigerant. Preferably, the temperature range is between approximately 10° F. and −15° F. That is, the pressure in the boiler 6 is adjusted to the desired conditioning of the refrigerant and depending upon the particular refrigerant.

For example, in reclaiming R-12, the pressure in the boiler 6 is adjusted to 14 psi thereby allowing the refrigerant R-12 to vaporize at 10° F. temperature.

The now vaporized refrigerant leaves the refrigerant boiler 6 through the suction line 12 passing through an on/off hand valve 14 into the suction accumulator 17. The refrigerant vapors enter the suction accumulator 17 which prevents liquid refrigerant from being pulled over into the compressor 23.

Vapors leaving the suction accumulator 17 can be routed directly into the suction side of the compressor 23 or if desired, due to the nature of the contaminated refrigerants, through a conventional acid filter 20 by proper actuation of hand valves 18, 19, and 21. Opening valve 18 and closing valves 19 and 21 routes the refrigerant vapors directly to refrigerant angle valve 22 and to the compressor 23. Closing valve 18 and opening valves 19 and 21 routes the refrigerant vapors through the acid filter 20.

The refrigerant's vapors enter the compressor 23 at a low pressure and temperature, for example in the typical operation of reclaiming R-12 the pressure is 12 psi and the temperature is 12° F. The compressed vaporized refrigerant leaves the compressor 23 at a higher temperature and pressure, such as a temperature of 100° F. and pressure of 117 psi for R-12. The heated compressed refrigerant passes through refrigerant angle discharge valve 24 and pressure outlet line 25 through a conventional oil separator 26. In the oil separator 26, any oil that is carried over from the compressor 23 is removed and returned through line 27 to the sump of compressor 23.

The hot compressed refrigerant vapor in the pressure line 25 can then be routed entirely to a primary condenser 28 or entirely through a secondary condenser 29 or partially through both. Generally, some hot refrigerant always goes through condenser 28, particularly when in the recycling mode as will be discussed hereinafter. However, in some conditions, the refrigerant in line 25 is too hot and it all is routed through the secondary condenser 29.

If the hot, compressed refrigerant vapor is routed entirely to the primary condenser 28 then the hand operated valve 30 feeding a secondary condenser 29 and the hand operated valve 32 controlling the liquid discharge under secondary condenser 29 is closed. If the hot, compressed refrigerant vapor is routed entirely through the secondary condenser 29 then the hand operated valve 33 feeding the primary condenser 28 is closed then the two hand operated valves 30 and 32 would be open allowing the hot, compressed refrigerant gases to condense in the secondary condenser before entering the primary condenser 28 as a hot liquid. The visual presence and/or condition of the condensed refrigerant leaving the secondary condenser may be noted in the sight glass 31.

If because of operating conditions or circumstances, such as the quantity of vapors entering the primary condenser 28, it is desirable to partially route some of the hot compressed refrigerant vapor leaving the line 25 to lower the temperature of the hot refrigerant vapor entering the primary condenser 28, then hand operated valves 30 and 32 are partially opened allowing some of the vapor access to the secondary condenser 24 before entering the primary condenser 28 through the line 35 before entering the primary condenser 28. A pressure gauge 36 and line 25 allows the operator to monitor the pressure in the primary condenser 28 by noting the effect and varying the amount of the hot compressed refrigerant vapors passing through the secondary condenser 29.

If the hot gas entering the primary condenser 28 causes a boiling action and excess pressures, then the hot gas is shifted to condenser 29. For example, the normal pressure of R-12 in the boiler should be 14 psi. If the pressure increases to 20 psi, the pressure is controlled by limiting the amount of hot gas flowing to condenser 28.

If the hot, refrigerant vapor is condensed in the secondary condenser 29, water may be used to remove the excess heat. The flow of water is controlled by hand operated valve 37 controlling the inlet flow of water through line 38 and back out the water return line 39 controlled by hand operated valve 40.

A housing 80 is provided surrounding the refrigerant boiler 6 for containing the primary condenser 28, a sump 42 and a non-condensable gas purge chamber 43 which is separated from the primary condenser 28 by partitions 82 and 84. Any hot, compressed refrigerant vapor entering the primary condenser 28 from the line 25 will be discharged through the hot gas spray tree 41 insuring even distribution against the refrigerant boiler 6. The heat of compression found in the hot, compressed refrigerant gases that is absorbed through the wall of the refrigerant boiler 6 causes the liquid refrigerant in the boiler 6 to boil and cools the heated compressed vapor from the compressor 23 causing it to condense to a liquid.

Liquid from the secondary condenser 29 entering through the secondary condenser discharge line 35 into the primary condenser 28 will cause a limited boiling action because most of its heat was left in the secondary condenser 29. Liquid entering either directly from the secondary condenser 29, or after changing from a gas into a liquid entering the primary condenser 28, will collect as such, as a condensed liquid in the sump 42.

Any non-condensable gases, such as air, oxygen or nitrogen that might be present in the refrigerant will rise to the high point of the primary condenser 28 allowing them to be collected in the purge chamber 43 and discharged to the atmosphere.

Non-condensable gases feed line 44 allowing the non-condensable gases to be collected from the high points of the primary condenser 28 and enter into the purge chamber 43 through the purge needle valve 45. Since the purge chamber 43 is in a heat exchange relationship with the cold inner wall of refrigerant boiler 6, any refrigerant remaining in the non-condensable gases entering the purge chamber 43 will condense and fall to the bottom of the chamber 43 adjacent the partition 82. This condensed refrigerant is now in liquid form. Once the condensed liquid refrigerant collects to a sufficient level in the bottom of the purge chamber 43, the float assembly 54 will allow the now liquid refrigerant to leave. The rate at which the liquid refrigerant leaves through the purge refrigeration line 47 is controlled by the purge refrigeration line needle valve 48.

The path of the liquid refrigerant after leaving the purge chamber 43 and travelling through the purge refrigeration line 47 passes through the sight glass 53 which allows the operator to visually monitor the level of the refrigerant in the bottom of the purge chamber. The purge float assembly 54, which requires a predetermined liquid level before opening, will prevent recirculation of non-condensable gases. After passing through the purge float assembly 54 the liquid refrigerant then passes through moisture filter 55 before being metered by the needle valve 48 into the purge cooling coil 49.

The purge refrigeration line needle valve 48 is used to meter the liquid refrigerant into the purge cooling coil 49 which is positioned in the purge chamber 43. This metering effect will cause the liquid refrigerant to vaporize thereby cooling the purge cooling coil 49. This vaporized refrigerant will enter the refrigerant boiler 6 directly through the purge cooling coil outlet 50. Because the pressure in the refrigerant boiler 6 is lower than the pressure in the purge chamber 43, the liquid refrigerant will continuously vaporize in the purge cooling coil 49 causing a refrigeration effect.

The purge cooling coil 49 will act, in addition to the cold inner wall of the refrigerant boiler, to condense any refrigerant entering with the stream of non-condensable gases. This combined cooling effect makes the purge chamber 43 more effective and insures a continuous level of refrigerant in the bottom of the purge chamber 43.

As the non-condensable gases collect in the top of the purge chamber 43, an adjustable pressure relief valve 51 is set to release these gases to the atmosphere at whatever pressure is appropriate to the operating conditions of the refrigerant being processed.

The hot condensed refrigerant that had been collected in the sump 42 can be further cooled to facilitate ease of returning to the refrigerant source 11. A sump sub-cooler coil 58 in the sump 42 is cooled by a liquid refrigerant leaving the sump 42 through the sump sub-cooler input line 56 and being metered into the sump sub-cooler coil 58 by needle valve 57. The vaporized refrigerant then leaves the coil 58 through the sump sub-cooler line 59 and is passed into the refrigerant boiler 6 through discharge line outlet 60. The lower pressure in the boiler 6 continuously causes any liquid refrigerant in the sump cooler coil 58 to vaporize. The refrigerant leaving the sump 42 travels through the sump discharge line 61. The level of the refrigerant in the sump 42 is indicated by the level of the refrigerant in the sump level gauge 62.

The refrigerant leaving the sump 42 can be routed through one or two banks of moisture filters 63 and 71 which can be placed in series or parallel. This can be accomplished by the selective operation of valves 64, 65, 67, 68, and 69. The normal mode is that the refrigerant passes through the moisture filters 63 and 71 in series, first through the first moisture filter 63 and then through the second filter 71 in order to expose the refrigerant to a maximum filter area. In order to affect this valve 64 is closed, valve 65 is opened, valve 68 is closed, valve 67 is opened, and valve 69 is opened. Valves 66 and 72 are moisture indicators. The reclaimed clean refrigerant is transmitted through discharge line 70 through a check valve 73 and can be monitored by the sight glass 74 and controlled by hand valve 75 and thus can be returned to the source 11 at a pressure of 100 psi and a temperature of 90° F.

In addition, hand valve 9 and needle valve 8 are provided between the discharge line 70 and the inlet line 1 for recycling part of the reclaimed refrigerant allowing it to enter the input line 1 downstream from the needle valve 5 thereby increasing the purity of the reclaimed refrigerant.

Any solid particles in the boiler 6, such as rust, metal, shavings, etc., and/or moisture in liquid form that has separated from the refrigerant, and/or acids which tend to remain behind with oil and free water, and/or whose boiling point is much lower than the refrigerant are periodically drained from the boiler 6. This is performed by opening valve 100.

In addition to the capabilities already stated, the apparatus 10 has also been designed to separate large quantities of non-condensable gases from high pressure refrigerants while the refrigeration system 11 remains operational. This is accomplished by extracting a quantity of refrigerant, in the liquid state, from the system 11 which serves as an operational charge of refrigerant for the refrigerant boiler 6 and refrigerant sump 42. Once an adequate amount has been obtained, the apparatus 10 is started and valve 9 is opened and valve 8 is adjusted to perform the function of an expansion valve.

By recirculating the refrigerant in a closed loop, its temperature and pressure can be lowered to approximately zero degrees Fahrenheit, or lower if desired. Line 1 is connected to the high point of the customer's condenser where the highest accumulation of non-condensables should exist. Hand valve 3, situated on line 1, is opened and needle valve 5 is adjusted to permit the proper flow of non-condensables and refrigerant gases from the customer's condenser in system 11 to flow into the refrigerant boiler 6 via the refrigerant inlet 7. As these vapors come in contact with the cold liquid refrigerant being maintained in the refrigerant boiler, which remains approximately half full, the refrigerant vapors, to a large extent, condense and the non-condensables continue to rise to the surface.

This concentration of non-condensables and some additional refrigerant vapors are drawn through the suction, compressed and discharged into primary condenser 28. At this point in time the remaining refrigerant is condensed leaving a high concentration of non-condensables at the top of the primary condenser 28. The function of the non-condensables purge chamber 43, which has been previously described, is to separate the last remaining refrigerant and dispose of the non-condensables through valve 51.

The present apparatus then can virtually remove all oil, acid, and solid particles from the refrigerant and can reduce the moisture content to 10 parts per million.

The present invention 10 has the ability to reclaim refrigerants to ARI (Air/Conditioning Refrigeration Institute) 700-88 standards. In one embodiment the apparatus 10 has the ability to reclaim quantities ranging from 500 pounds to 50,000 pounds and can process refrigerants at the rate of approximately 1,000 pounds per hour in the case of high pressure refrigerants and at the range of 250 pounds per hour for low pressure refrigerants.

Preferably, the present invention 10 is skid mounted (not shown) for providing a portable apparatus which can be carried to various refrigeration systems 11 at industrial sites for permitting the recycling and reclaiming to be performed while the refrigeration apparatus 11 continues operating thus preventing loss of production by the refrigeration system 11. In addition to reclaiming and recycling contaminated refrigerant, the present apparatus 10 is also capable of transferring refrigerant. Vapor suction line 101 may be connected to a vapor auxiliary suction for transferring refrigerant vapor by opening hand valves 16 and 15 and drawing in vapor through the compressor 23, compressing and heating the vapor by the compressor 23 and discharging the vapor through line 102 through valves 30 and 104, or in the alternative condensing the compressed vapor in the secondary condenser 29 and transferring the condensed liquid through line 105 and valve 106.

It is to be noted that the closed loop system of the apparatus 10 provides an environmentally protective method and apparatus for withdrawing refrigerants from the refrigerant system 11 with the ability to transfer, reclaim, recycle and recharge the refrigerants into the system 11 without allowing the escape of refrigerant to the atmosphere.

The invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts, and steps of the process, will be readily apparent to those skilled in the art, and which are encompassed within the spirit of the invention and the scope of the appended claims.

What is claimed is:

1. A refrigerant reclamation apparatus comprising, a refrigerant boiler having a refrigerant inlet for admitting contaminated refrigerant into the boiler, and having a vapor outlet, a compressor having a suction inlet and a pressure outlet, said suction inlet connected to the vapor outlet of the boiler for lowering the pressure in the boiler for drawing refrigerant into the boiler from the refrigerant inlet and for vaporizing the refrigerant in the boiler, a condenser connected to the pressure outlet of the compressor receiving a heated compressed refrigerant vapor, said condenser being in a heat exchange relationship with the boiler for heating the boiler and cooling the heated compressed vapor from the compressor to a condensated liquid, a sump connected to the condenser for receiving the condensed liquids, and a non-condensable gas purge chamber connected to the top of the condenser for receiving non-condensable gases, said purge chamber positioned in a heat exchange relationship with boiler for condensing any refrigerant in the chamber.

2. The apparatus of claim 1 including, a cooling coil positioned in the purge chamber for receiving and vaporizing part of the condensed refrigerant, said cooling coil connected to the boiler for transmitting the vaporized refrigerant to the boiler, and a gas outlet in the top of the purge chamber for release of non-condensable gases.

3. The apparatus of claim 2 including, a liquid float assembly connected to the cooling coil for controlling the liquid refrigerant leaving the purge chamber.

4. The apparatus of claim 1 including a recycling circuit connected between the sump and the boiler for recycling and purifying the refrigerant.

5. The apparatus of claim 1 including a housing positioned about the boiler, said housing surrounding the boiler and forming the condenser, purge chamber and sump.

6. The apparatus of claim 1 including, a sump sub-cooler coil including a cooling coil in the sump, said cooling coil connected between the sump and the boiler, whereby the liquid refrigerant in the sump vaporizes and cools the sump.

7. The apparatus of claim 1 including, a second condenser connected to the pressure outlet of the compressor upstream of the first condenser.

8. The apparatus of claim 1 including, an inlet line having a sight glass connected to the refrigerant inlet, an outlet line connected to the sump for receiving reclaimed condensed liquids, said inlet line and said outlet line adapted to be connected to a refrigerant source for continuously reclaiming refrigerant.

9. The method of reclaiming a refrigerant through a closed process preventing release of the refrigerant to the environment comprising, withdrawing the refrigerant from a refrigeration system and into a boiler, lowering the pressure in the boiler by suction sufficiently to vaporize the refrigerant at a temperature of between approximately 10° F. and −15° F. while insufficient to vaporize oil, most acids, and most of the water, removing the vaporized refrigerant from the boiler and compressing the vaporized refrigerant increasing the temperature, passing the heated vaporized refrigerant in a heat exchange relationship with the boiler heating the boiler and condensing the vaporized refrigerant, and recharging the refrigeration system with the condensed refrigerant.

10. The method of reclaiming a refrigerant through a closed process preventing release of the refrigerant to the environment comprising, withdrawing the refrigerant from a refrigeration system and into a boiler, lowering the pressure in the boiler by suction sufficiently to vaporize the refrigerant, removing the vaporized refrigerant from the boiler and compressing the vaporized refrigerant increasing the temperature, passing the heated vaporized refrigerant in a heat exchange relationship with the boiler heating the boiler and condensing the vaporized refrigerant, collecting and removing any non-condensable gases from the condensed refrigerant, and recharging the refrigeration system with the condensed refrigerant.

11. The method of claim 10 including, passing the non-condensable gases in a heat exchange relationship with the boiler for condensing and extracting any refrigerant therefrom.

12. The method of claim 11 including, vaporizing any extracted refrigerant and returning it to the boiler.

13. The method of claim 9 including, cooling the heated vaporized refrigerant prior to the heat exchange passage with the boiler.

14. The method of claim 9 including, cooling the condensed refrigerant by vaporizing part of the refrigerant, and inserting the vaporized part into the boiler.

15. The method of claim 9 including recycling part of the condensed refrigerant for further purifying the refrigerant.

16. The method of separating large quantities of non-condensable gases from high pressure refrigerants from a refrigeration system comprising, extracting a quantity of refrigerant from the system and placing the extracted refrigerant in a boiler, lowering the pressure in the boiler to vaporize the refrigerant, compressing the vaporized refrigerant, passing the compressed refrigerant in a heat exchange relationship with the boiler in a closed loop, thereby lowering the temperature of the refrigerant, flowing non-condensable gases from the system into the boiler and separating any refrigerant from the non-condensable gases, and withdrawing, compressing, cooling, collecting, and removing the non-condensable gases from the refrigerant.

* * * * *